US006000988A

United States Patent [19]

Tsai

[11] Patent Number: 6,000,988

[45] Date of Patent: Dec. 14, 1999

[54] FIGHTING UFO TOY CAR

[76] Inventor: Wen-Ho Tsai, 8F, No. 113, Yu-Jen Rd., Pei-Tou Dist., Taipei, Taiwan

[21] Appl. No.: 09/166,153

[22] Filed: Oct. 5, 1998

[51] Int. Cl.[6] ..... A63H 17/00

[52] U.S. Cl. ..... 446/231; 446/457; 446/465; 446/470

[58] Field of Search ..... 446/230, 231, 446/431, 457, 465, 470

[56] References Cited

U.S. PATENT DOCUMENTS

| | | | |
|---|---|---|---|
| 4,209,941 | 7/1980 | Bourque | 446/231 |
| 4,467,556 | 8/1984 | Iwao et al. | 446/230 |
| 4,717,367 | 1/1988 | Stubenfoll et al. | 446/457 X |
| 5,139,456 | 8/1992 | Chuang | 446/231 |
| 5,525,090 | 6/1996 | Halford et al. | 446/465 |
| 5,803,790 | 9/1998 | Tilbor et al. | 446/465 X |

*Primary Examiner*—John A. Ricci
*Attorney, Agent, or Firm*—Dougherty & Troxell

[57] ABSTRACT

A fighting UFO toy car in which a power source such as a motor is used to drive a gear set which further drives a cam of a driving shaft to rotate and make a UFO model ascend and show up outside the toy car. The driving shaft synchronously drives guide members on two outer sides of the casing to rotate. The guide members drive two rocking arms to regularly swing to drive a resilient linking member which further drives a lifting support shaft to vertically move. Accordingly, two wings disposed on two sides of the toy car body are stretched and retracted. The gear set drives a rotary disc of a driving shaft to rotate, whereby a cam of the rotary disc drives a guide board to regularly slide back and forth. By means of such arrangements, multiple sets of decorations mounted on outer side of the toy car body are lively repeatedly operated to achieve an entertaining effect.

10 Claims, 6 Drawing Sheets

FIGHTING UFO TOY CAR

BACKGROUND OF THE INVENTION

The present invention relates to a fighting UFO toy car in which after activated, the toy car body can ascend and rotate and descend. In addition, decorations at front end of the toy car body can regularly extend and retract back and forth. A top section of the toy car body is equipped with a UFO model which can ascend out of the toy car body. Two wings are disposed on two sides of the toy car body, which can be stretched and retracted.

A conventional toy car is usually designed with attractive appearance and simple actions such as running and sound/light effect. However, such toy car lacks a transmission mechanism which is able to create versatile and live actions. Therefore, the conventional toy car can hardly satisfy the requirement of children. An improved toy car has been developed, which includes a transmission mechanism able to create various special actions. However, such transmission mechanism is quite complicated so that the cost is relatively high and the possibility of malfunction is increased. Therefore, it is necessary to develop a toy car which is able to create versatile and live actions without increasing Manufacturing cost.

SUMMARY OF THE INVENTION

It is a primary object of the present invention to provide a toy car which is able to create versatile and live actions and which is manufactured at low cost.

The present invention can be best understood through the following description and accompanying drawings, wherein:

DETAILED DESCRIPTION OF THE PREFERRED EMBODIMENT

Figure 1:
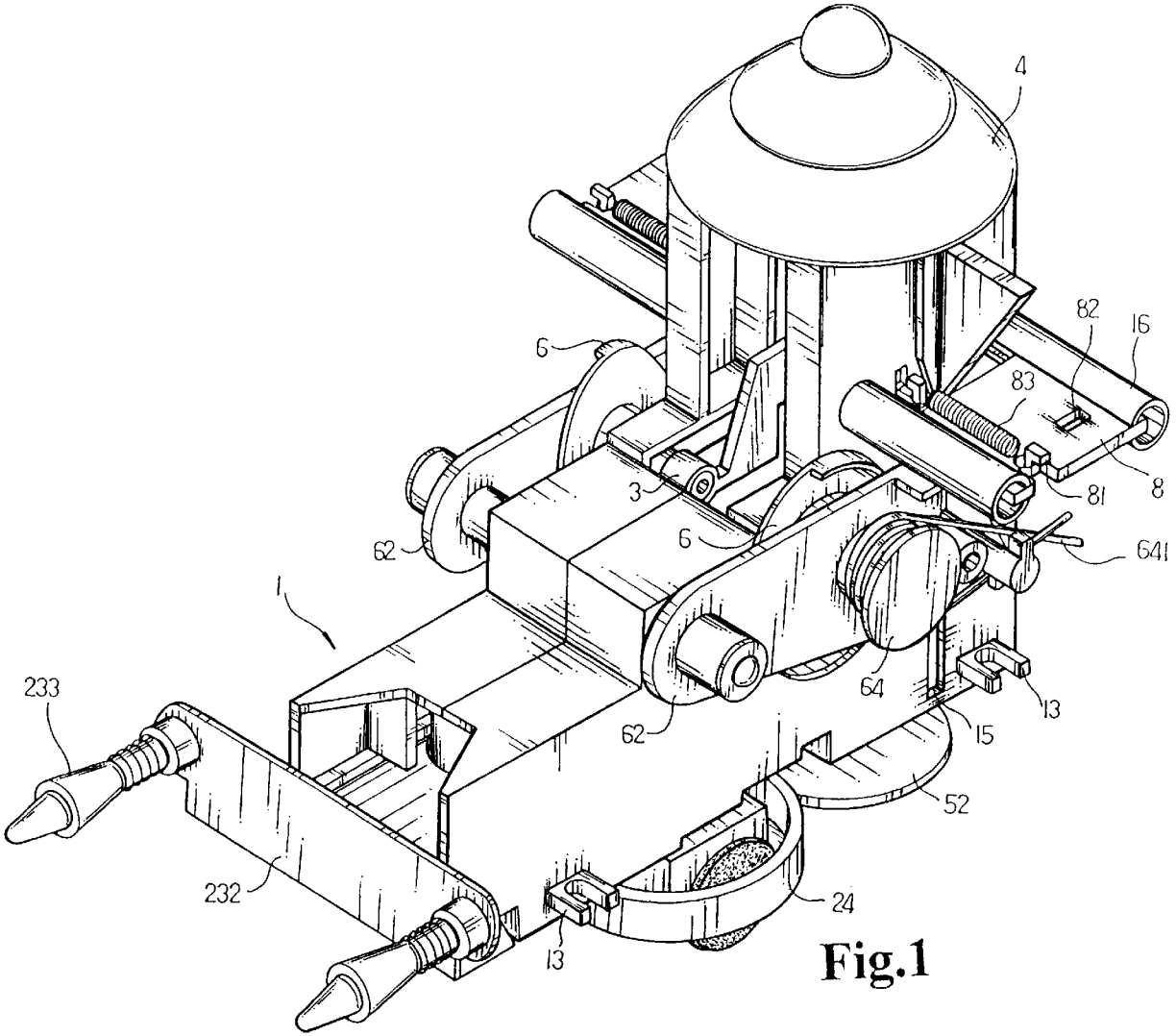
FIG. 1 is a perspective assembled view of the present invention.
Figure 2:
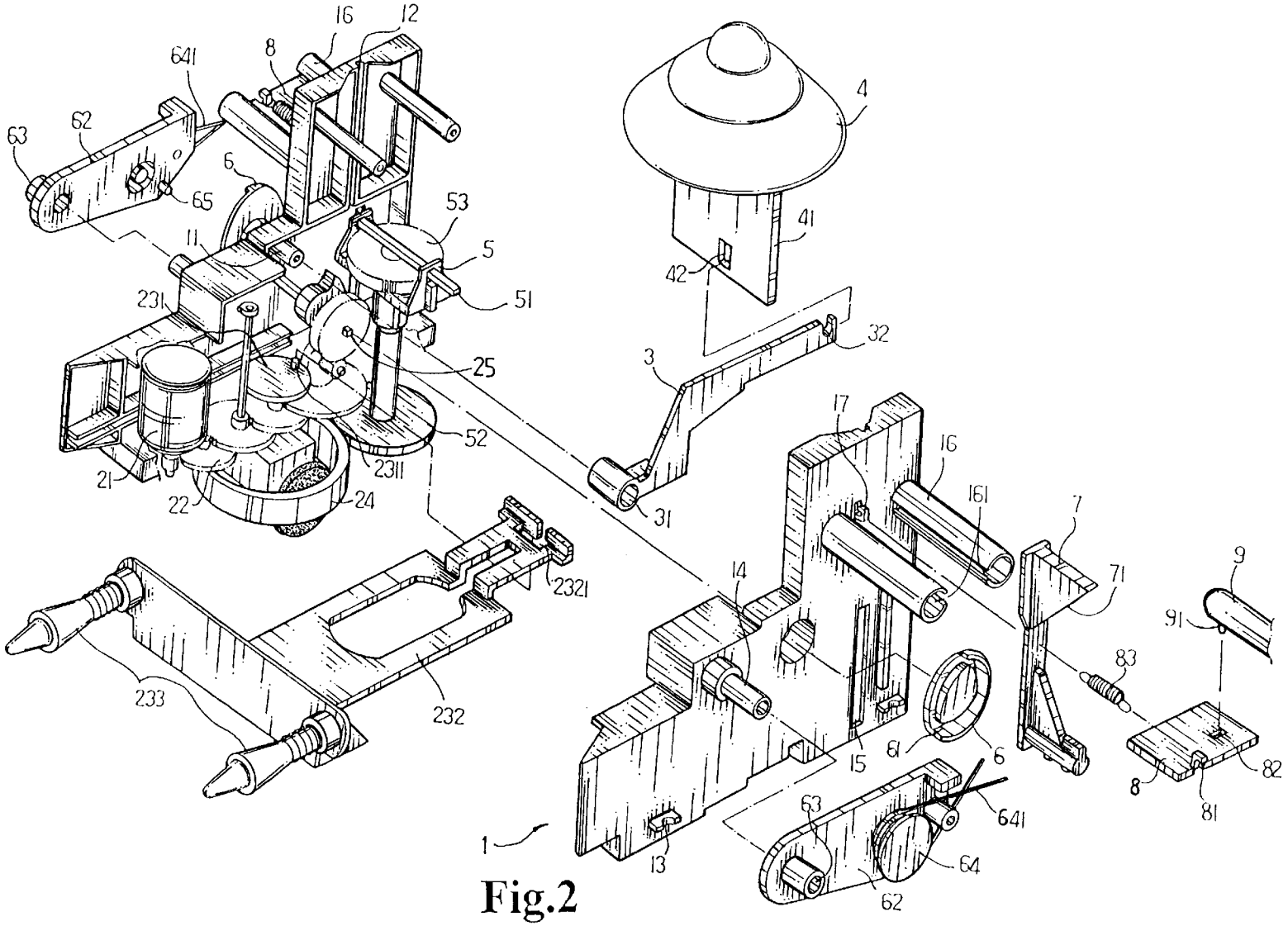
FIG. 2 is a perspective disassembled view of the present invention.

Please refer to FIGS. 1 and 2. The present invention includes a housing 10 and a casing 1 mounted in the housing 10. One end of the casing 1 is disposed therein with a power source 21 such as a motor. The power source 21 via a gear set 22 respectively drives a driving shaft 23 and a rotary power wheel set 24. The gear set 22 also drives a guide member driving shaft 25. Two ends of the guide member-driving shaft 25 extend to two outer sides of the casing 1 to connect with guide members 6 (such as a cam) for outputting the power. In addition, the guide member-driving shaft 25 is disposed with a cam 251 which is rotatable along with the driving shaft 25. The periphery of the guide member 6 is formed with guide groove 61. Two sides of the bottom of the casing 1 are respectively disposed with casing supports 13 for locking the casing in the toy car. Two sides of outer edge of the casing 1 are additionally disposed with fulcrum seats 14, slits 15, guide lever seat 16 and a hook section 17. The fulcrum seat 14 is inserted in a seat hole 63 of one end of a rocking arm 62. The inner side of the rocking arm 62 has a projecting pin 65 slidably extending into the guide groove 61 of the guide member 6. When the guide member 6 rotates, the projecting pin 65 is driven. The rocking arm 62 is further disposed with a linking member seat 64 which cooperates with a guide seat to support a resilient linking member 641. An end section of the linking member 641 clamps a pushing member 7 which is attached to outer side of the slit 15 of the casing 1. A lifting support shaft 5 is disposed in the casing 1. The bottom end thereof is disposed with a support seat 52 extending out of the bottom of the casing 1. A top side of the lifting support shaft 5 is disposed with a transverse connecting rod 51. Two ends of the connecting rod 51 extend out of the slits 15 of the casing 1 to connect with the pushing member 7 by insertion. The top end of the lifting support shaft 5 is connected with a gear 53 under the connecting rod 51. One end of the driving shaft 23 is disposed with a rotary disc 231. The rotary disc 231 is formed with a flange 2311 for fitting into a slide groove 2321 of a guide board 232. A decoration 233 is mounted on the guide board 232 and pushable thereby. The other end of the driving shaft 23 is connected with the rotary power wheel set 24. The guide lever seat 16 is formed with a guide groove 161 for a slide board 8 to insert therein. The slide board 8 is disposed with a hook section 81 which via a spring 83 is pulled and connected with the hook section 17 of the casing 1. The slide board is formed with a through hole 82 for a projecting post 91 of a wing 9 to extend therein. The casing 1 is disposed with a lifting fulcrum seat 11 therein for pivotally inserting into a fulcrum hole 31 of one end of a lifting member 3. The tail end of the lifting member 3 extends into and connect with a base section of a UFO model 4. The inner side of the casing 1 is formed with a longitudinal slide groove 12 for two sides of the UFO. model 4 to slidably fit therein, whereby the UFO model 4 is restricted and vertically slidable.

Figure 3:
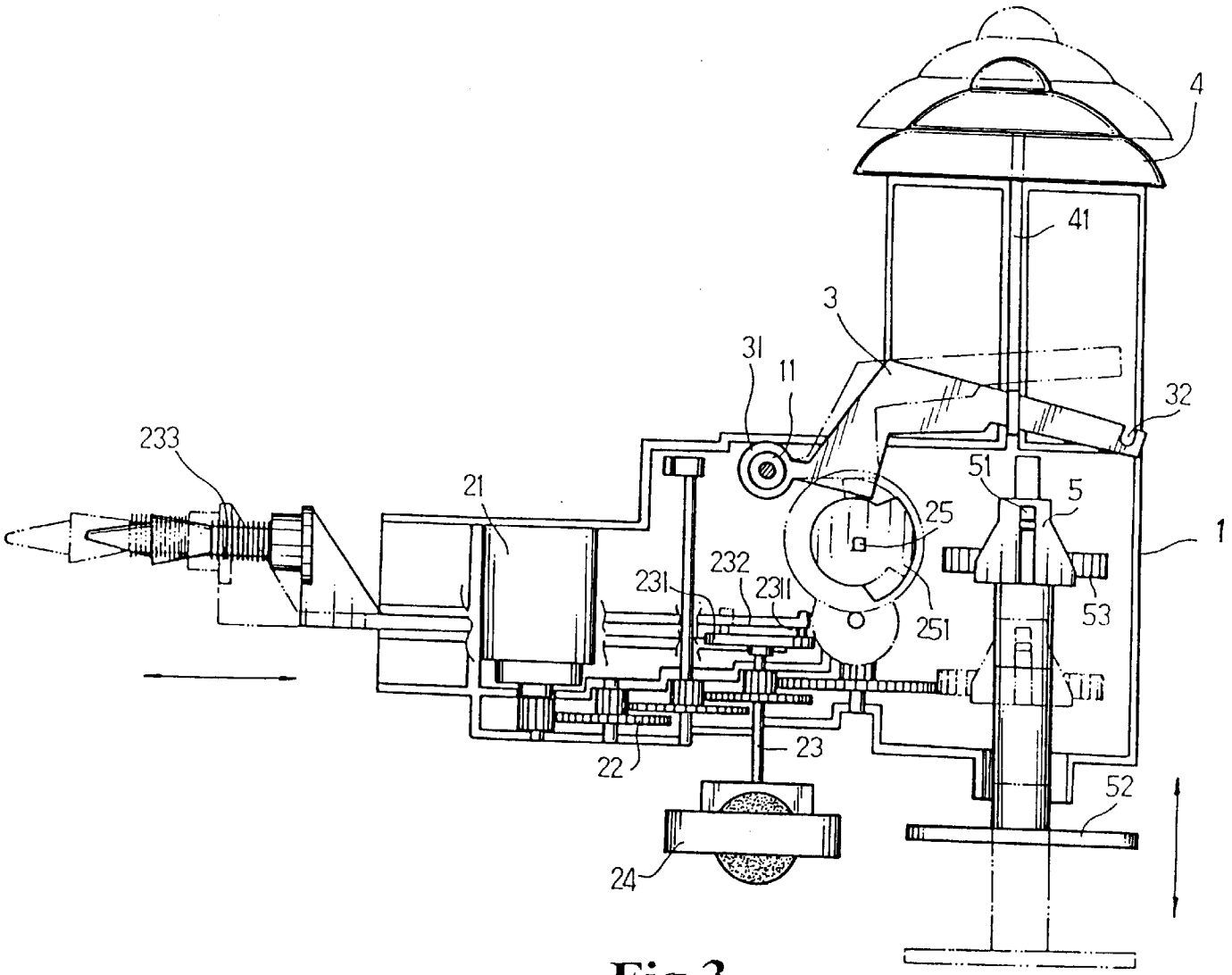
FIG. 3 is a sectional view showing the operation of the components in the casing of the present invention.
Figure 4:
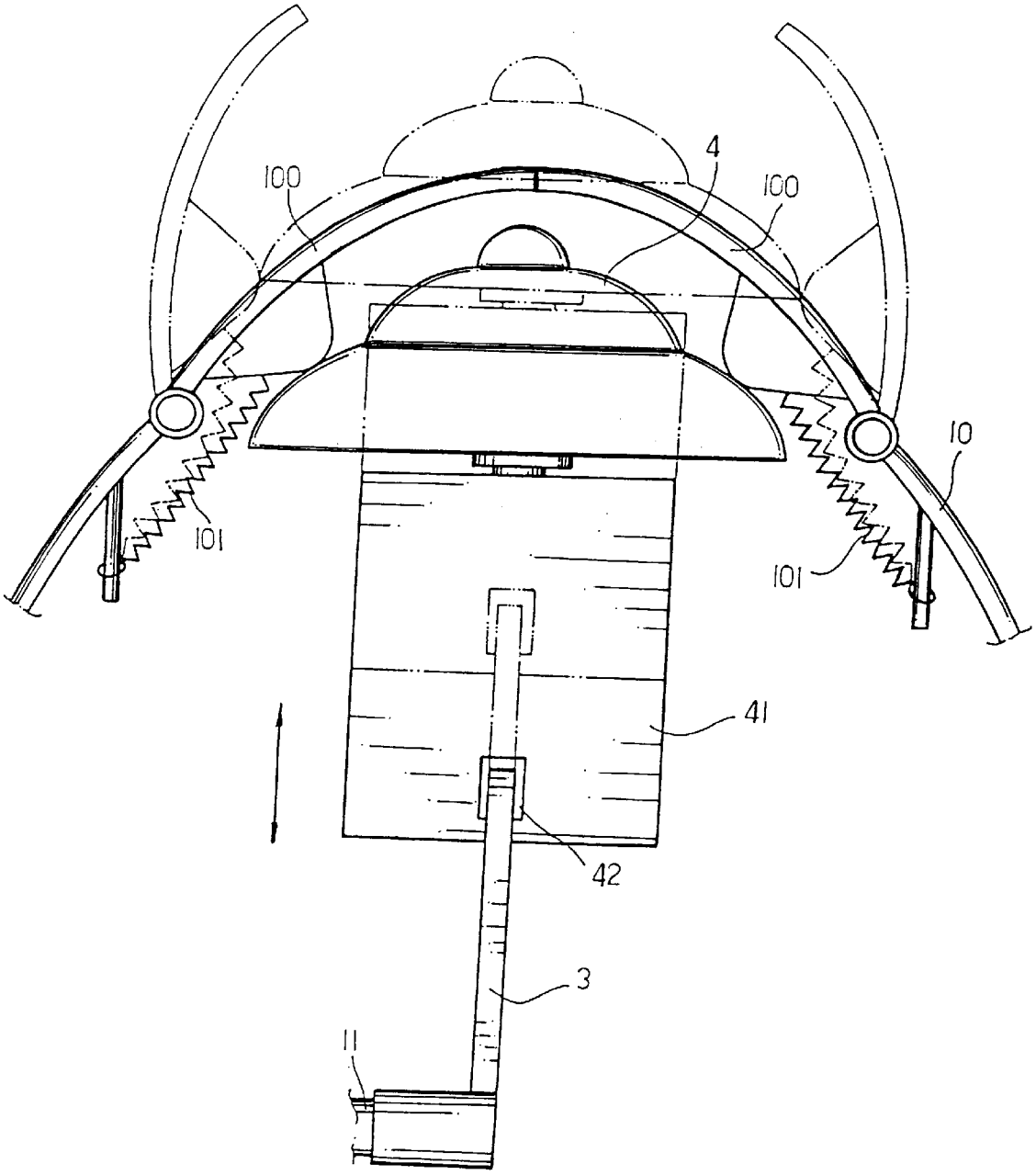
FIG. 4 shows the operation of the UFO model and tent of the present invention.
Figure 5:
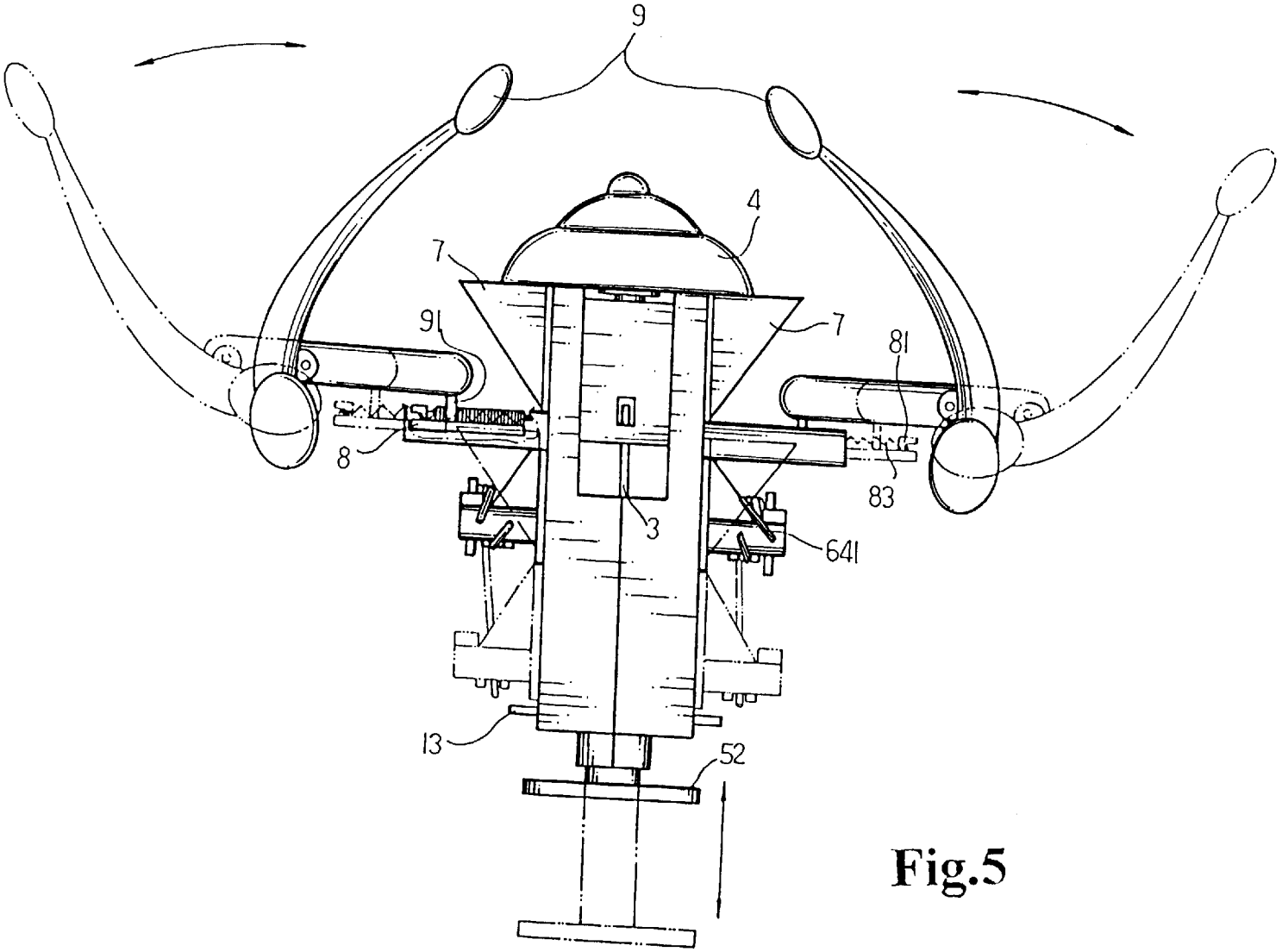
FIG. 5 shows the operation of wings and slide boards of the present invention.
Figure 6:
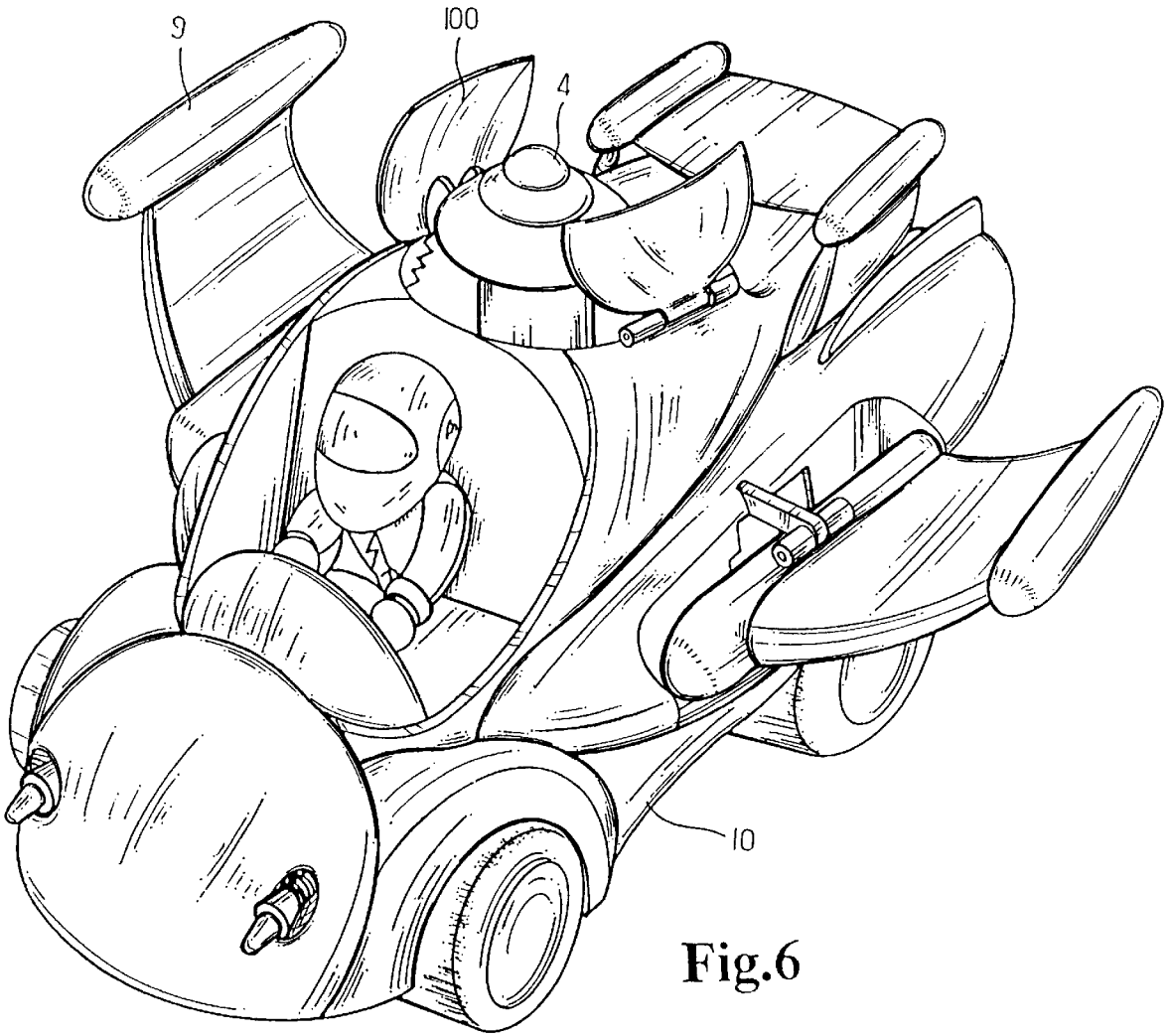
FIG. 6 shows the appearance of the toy car of the present invention.

Please refer to FIGS. 3 and 4. When the power source 21 rotates, the cam 251 of the guide member driving shaft 25 rotarily pushes and lifts the lifting member 3. The tail end of the lifting member 3 is swung upward about the lifting fulcrum seat 11 to lift and support the UFO model 4. The rotation of guide member 6 leads to sliding of the projecting pin 65 within the guide groove 61 so as to drive the rocking arm 62 to swing about the fulcrum seat 14. The rocking arm 62 via the linking member seat 64 drives the linking member 641 to swing. In the swinging movement, the tail end of the linking member 641 pulls the pushing member 7 to vertically slide along the slit 15. When the linking member 641 depresses the pushing member 7 to displace toward the lower end of the slit 15, the connecting rod 51 can move downward along with the pushing member 7.

Therefore, the lifting support shaft 5 is depressed by the connecting rod 51 to abut against the ground from the lower side of the casing 1, whereby the casing 1 (the housing of the toy car) is relatively lifted. At this time, the gear 53 of upper end of the lifting support shaft 5 is engaged with the gear set 22 to make the lifting support shaft 5 rotate relative to the casing 1. Reversely, when the linking member 641 pulls the pushing member 7 to move upward to the upper end of the slit 15, the lifting support shaft 5 is retracted into the casing 1 and the gear 53 is disengaged from the gear set 22 so as to stop the lifting support shaft 5 from rotating relative to the casing 1. In addition, when the pushing member 7 is depressed by the linking member 641 to the lower end of the slit 15, the slide board 8 is pushed by a downward inclined pressing face 71 of upper side of the pushing member 7 to slide outward, whereby the wing 9 is stretched outward along therewith. Reversely, when the slide board 8 is released from the outward pushing force, the restoring force of the spring 83 will make the wing 9 restore to its home position. The driving shaft 23 is driven by the power source 21 to rotate. At this time, the flange 2311 of the rotary disc 231 at one end of the driving shaft 23 is driven to make the guide board 232 regularly move back and forth, whereby the decoration 233 is regularly moved back and forth along therewith.

Please refer to FIG. 4. The top section of the housing 10 is disposed with a tent 100 above the UFO model 4. The tent via a spring 101 is pulled and fixed to inner side of the housing 10. When the lifting member 3 is not yet lifted by the cam 251 of the driving shaft 25, the UFO model 4 is not lifted. However, when the cam 251 lifts the lifting member 3, the UFO model 4 is pushed and lifted to force the dent 100 to open outward. At this time, the UFO model 4 extends out of the car body. Reversely, when the lifting member 3 is released from the pushing force of the cam 251, the UFO model 4 is gradually lowered and restored to its home position and the tent 100 is closed and restored to its home position by the restoring force of the spring 101.

According to the above arrangement, after the power source 21 is activated, the gear set 22 is driven to continuously drive the rotary disc 231 of the driving shaft 23. Accordingly, the flange 2311 of the rotary disc 231 drives the guide board 232 and the decoration 233 to regularly slide back and forth. The gear set 22 via the driving shaft 25 drives the guide member 6 to drive the rocking arm 62 to swing. At this time, the linking member 641 is driven by the rocking arm 62 to make the pushing member 7 and connecting rod 51 positioned at upper end of the slit 15. At this time, the driving shaft 23 drives the rotary power wheel set 24 and the toy car can contact the ground to run around. When the guide member 6 drives the rocking arm 62 to swing downward so as to gradually lower the pushing member 7, the connecting rod 51 is depressed to the lower end of the slit 15, whereby the lifting support shaft 5 lifts and supports the casing 1 and the housing 10. Also, the wings 9 on two sides of the car body are pushed by the pushing member 7 and the slide board 8 is slided outward to stretch open the wings 9. At this time, the rotary power wheel set 24 leaves the ground and fails to act on the toy car. When the lifting support shaft 5 is moved downward to a lowest position, the gear 53 at the top end is engaged with the gear set 22. By means of the rotary power of the gear set 22, the toy car body can rotate in the air. Moreover, when the cam 251 of the driving shaft 25 rotates to lift the lifting member, the UFO model is lifted to show up at the top of the toy car.

It should be noted that the above description and accompanying drawings are only used to illustrate one embodiment of the present invention, not intended to limit the scope thereof. Any modification of the embodiment should fall within the scope of the present invention.

What is claimed is:

1. A fighting UFO toy car comprising a housing and a casing mounted in the housing, one end of the casing being disposed therein with a power source, the power source via a gear set respectively driving a driving shaft and a guide member driving shaft, a bottom end of the driving shaft extending out of the casing and the housing and connected with a rotary power wheel set, the other end of the driving shaft being disposed with a rotary disc which drives a guide board, a cam being disposed on the guide member driving shaft, a lifting member being correspondingly disposed beside the cam, two ends of the guide member driving shaft extending to two outer sides of the casing to connect with a guide member, two sides of outer edge of the casing being disposed with fulcrum seats, slits and guide lever seat, the fulcrum seat being inserted in a seat hole of one end of a rocking arm, an inner side of the rocking arm having a projecting pin slidably extending into a guide groove of the guide member, the rocking arm being further disposed with a linking member seat which supports a resilient linking member, an end section of the linking member clamping a pushing member which is attached to outer side of the slit of the casing, a transverse connecting rod extending from the casing to insert with the pushing member, the connecting rod being disposed on a lifting support shaft in the casing, a bottom end of the lifting support shaft extending out of the base of the casing and being disposed with a support seat, a top end of the lifting support shaft being disposed with a gear which is driven by the gear set to rotate, the guide lever seat being disposed with a guide groove for a slide board to slidably insert therein, the slide board being resiliently slidably pushed by the pushing member, decorations are respectively connected to the guide board, lifting member and slide board, whereby when the toy car runs, the decorations are driven to create various actions and the toy car body is lifted and supported by the lifting support shaft to rotate.

2. A toy car as claimed in claim 1, wherein when the linking member is driven by the rocking arm to press down the pushing member and the connecting rod, the support seat is lowered to a lower dead end, whereby the gear is engaged with the gear set to make the support seat rotate relative to the lifting support shaft so that the toy car body is lifted and rotated.

3. A toy car as claimed in claim 2, wherein the slide board is disposed with a hook section which via a spring is pulled and connected to a hook section of outer side of the casing, the slide board being formed with a through hole for a projecting post of a wing to extend thereinto, the pushing member having a downward inclined pressing face which from inner side to outer side attaches to the inner edge of the slide board, whereby when the linking member is driven by the rocking arm to make the pushing member and the connecting rod depressed, the slide board is pressed by the pressing face of the pushing member to slide outward, whereby the wings are outward stretched open.

4. A toy car as claimed in claim 1, wherein the rotary disc of top end of the driving shaft is disposed with a flange which extends into a slide groove of the guide board, whereby when the driving shaft rotates, the guide board is driven to move horizontally.

5. A toy car as claimed in claim 4, wherein the slide board is disposed with a hook section which via a spring is pulled and connected to a hook section of outer side of the casing, the slide board being formed with a through hole for a projecting post of a wing to extend thereinto, the pushing member having a downward inclined pressing face which from inner side to outer side attaches to the inner edge of the slide board, whereby when the linking member is driven by the rocking arm to make the pushing member and the connecting rod depressed, the slide board is pressed by the pressing face of the pushing member to slide outward, whereby the wings are outward stretched open.

6. A toy car as claimed in claim 1, wherein one end of the lifting member is disposed with a fulcrum hole in which a lifting fulcrum seat in the casing is pivotally inserted, a tail end of the lifting member extending into and connecting with a base section of UFO model, a longitudinal slide groove being formed in the casing for two sides of the UFO model to slidably fit therein, whereby when the cam of the guide member driving shaft under the lifting member rotates, the lifting member is driven to make the UFO model vertically slided in a restricted direction.

7. A toy car as claimed in claim 6, wherein a tent is disposed on top end of the housing above the UFO model, the tent being inward pulled by a resilient member connected between the tent and the housing, whereby when the UFO model is lifted, the tent is first pushed open and when the UFO model is lowered, the tent is automatically restored and closed.

8. A toy car as claimed in claim 7, wherein the slide board is disposed with a hook section which via a spring is pulled and connected to a hook section of outer side of the casing, the slide board being formed with a through hole for a projecting post of a wing to extend thereinto, the pushing member having a downward inclined pressing face which from inner side to outer side attaches to the inner edge of the slide board, whereby when the linking member is driven by the rocking arm to make the pushing member and the connecting rod depressed, the slide board is pressed by the pressing face of the pushing member to slide outward, whereby the wings are outward stretched open.

9. A toy car as claimed in claim 6, wherein the slide board is disposed with a hook section which via a spring is pulled and connected to a hook section of outer side of the casing, the slide board being formed with a through hole for a projecting post of a wing to extend thereinto, the pushing member having a downward inclined pressing face which from inner side to outer side attaches to the inner edge of the slide board, whereby when the linking member is driven by the rocking arm to make the pushing member and the connecting rod depressed, the slide board is pressed by the pressing face of the pushing member to slide outward, whereby the wings are outward stretched open.

10. A toy car as claimed in claim 1, wherein the slide board is disposed with a hook section which via a spring is pulled and connected to a hook section of outer side of the casing, the slide board being formed with a through hole for a projecting post of a wing to extend thereinto, the pushing member having a downward inclined pressing face which from inner side to outer side attaches to the inner edge of the slide board, whereby when the linking member is driven by the rocking arm to make the pushing member and the connecting rod depressed, the slide board is pressed by the pressing face of the pushing member to slide outward, whereby the wings are outward stretched open.

* * * * *